United States Patent [19]

Noerpel

[11] Patent Number: 4,994,819

[45] Date of Patent: Feb. 19, 1991

[54] PATTERN DIVERSITY IN A MICROWAVE DIGITAL RADIO SYSTEM UTILIZING A SINGLE HORN REFLECTOR ANTENNA

[75] Inventor: Anthony R. Noerpel, Long Branch, N.J.

[73] Assignee: Bell Communications Research, Inc., Livingston, N.Y.

[21] Appl. No.: 440,887

[22] Filed: Nov. 24, 1989

[51] Int. Cl.[5] ..... H01Q 13/00; H01Q 19/00; H01P 1/16; H01P 5/12

[52] U.S. Cl. ..... 343/786; 333/21 R; 333/113; 342/361; 343/756

[58] Field of Search ..... 342/361, 362; 343/756, 343/776, 781 R, 786; 333/21 R, 113

[56] References Cited

U.S. PATENT DOCUMENTS

| | | | |
|---|---|---|---|
| 4,112,370 | 9/1978 | Monsen | 342/361 |
| 4,473,828 | 9/1984 | Mörz et al. | 343/786 |
| 4,769,825 | 9/1988 | Vogel | 375/40 |
| 4,914,443 | 4/1990 | Gans et al. | 343/786 |

OTHER PUBLICATIONS

"Excitation of Higher-Order Antenna Modes by Multipath Propagation", E. T. Harkless et al., IEEE Trans. on Comm. Tech., vol. Com-15, No. 4, pp. 597-603, Aug. 1967.

"Multimode Corrugated Waveguide Feed for Monopulse Radar", P. J. B. Clarricoats et al., IEE Proc., vol. 128, Pt. H. No. 2, pp. 102-110, Apr. 1981.

"A Mode Extraction Network for RF Sensing in Satellite Reflector Antenna", B. K. Watson et al., Int. Conf. on Ant. and Prop., IEE Con. Pub. 195, pp. 323-327, Apr. 1981.

*Primary Examiner*—Rolf Hille
*Assistant Examiner*—Peter Toby Brown
*Attorney, Agent, or Firm*—James W. Falk

[57] ABSTRACT

During multipath fading in a terrestrial digital radio system, off-axis arrival of signals excites higher-order modes in a horn reflector antenna. In the disclosed system specified ones of these higher-order modes and the fundamental mode are allowed to propagate in a main waveguide connected to the antenna. At least one of the higher-order modes is abstracted from the main waveguide and fed to a standby receiver while the fundamental mode is propagated intact to a main receiver.

Error occurrences in the fundamental and higher-order modes due to multipath fading are substantially uncorrelated. Hence, upon detecting an error in the signals delivered to the main receiver, the system switches to the standby receiver thereby to provide in a single-antenna a significant improvement in performance against multipath fading.

14 Claims, 2 Drawing Sheets

PATTERN DIVERSITY IN A MICROWAVE DIGITAL RADIO SYSTEM UTILIZING A SINGLE HORN REFLECTOR ANTENNA

BACKGROUND OF THE INVENTION

This invention relates to broadband communication systems and, more particularly, to improving the performance of terrestrial digital radio systems during periods of frequency-selective fading.

The reliability of terrestrial digital radio systems has been improved by the use of space-diversity and frequency-diversity techniques. When combined with so-called hitless (bit-by-bit) switching between on-line and standby radio receivers, these techniques reduce outage time caused by multipath fading phenomena.

On radio paths where outages are primarily due to frequency-selective (dispersive) multipath fading, it has been demonstrated that approaches based on pattern diversity provide protection equal to that of space diversity or frequency diversity but at lower cost. One known pattern-diversity approach requires two horizontally separated antennas which either are characterized by different beam patterns or are purposely misaligned in the elevation plane relative to boresight and to each other. While this approach does not need the expensive tall towers required by space-diversity systems, it still does require two separate antennas.

Another known pattern-diversity approach involves a single antenna with two separate main beams generated, for example, by using two purposely misaligned feeds. This approach provides protection against outage at the expense of deteriorated sidelobe performance and poor cross-polarization discrimination relative to that of a standard antenna.

Accordingly, efforts have continued by workers skilled in the art aimed at trying to devise other ways of improving the reliability of terrestrial digital radio systems during periods of frequency-selective fading. In particular, these efforts have concentrated on trying to develop a reliable system having a minimal amount of additional equipment and exhibiting good performance characteristics.

SUMMARY OF THE INVENTION

In accordance with the principles of the present invention, higher-order modes excited in an antenna of a digital radio system are allowed to propagate in a main waveguide connected to the antenna. At least one of these higher-order modes is abstracted from the main waveguide and fed to a standby receiver while the fundamental mode is propagated intact to a main or on-line receiver.

The invention is based on the recognition that error occurrences in the fundamental and higher-order modes due to frequency-selective fading are substantially uncorrelated. These modes thereby provide pattern diversity. Hence, upon detecting an error in the signals delivered to the main receiver, the system switches to the standby receiver, thereby providing in a single-antenna system a significant improvement in performance against multipath fading.

In accordance with the invention, a transition waveguide section is utilized to allow only four specified modes of those excited in the antenna to propagate in the main waveguide. By means of a coupler connected to the main waveguide, only a horizontally polarized higher-order mode is propagated in an auxiliary waveguide and delivered to the standby receiver. At the same time, the horizontally polarized fundamental mode is propagated intact in the main waveguide and delivered to the main receiver. Alternatively, only a vertically polarized higher-order mode can be abstracted form the main waveguide by a coupler and delivered to the standby receiver. In this case, the vertically polarized fundamental mode is delivered intact to the main receiver. Or both of the horizontally polarized and vertically polarized higher-order modes can be delivered to respective standby receivers while the horizontally polarized and vertically polarized fundamental modes are delivered intact to respective main receivers. In each case, substantially uncorrelated signals delivered to an associated pair of standby and main receivers provide a low-cost basis for improving the reliability of the system without degrading its performance.

BRIEF DESCRIPTION OF THE DRAWING

A complete understanding of the present invention and of the above and other features and advantages thereof may be gained from a consideration of the following detailed description presented hereinbelow in connection with the accompanying drawing, in which.

DETAILED DESCRIPTION

The principles of the present invention are applicable to broadband radio systems that include spaced-apart antenna-equipped ground stations that transmit and receive microwave signals. Herein, for purposes of a specific illustrative example, a terrestrial digital system operating at a frequency of 31 gigahertz (GHz) and having a bandwidth of 2.5 gigahertz (GHz) will be emphasized. Also, although a variety of antenna designs can in practice be employed in such a system, a conventional conical horn reflector antenna will be specified below.

Figure 1:
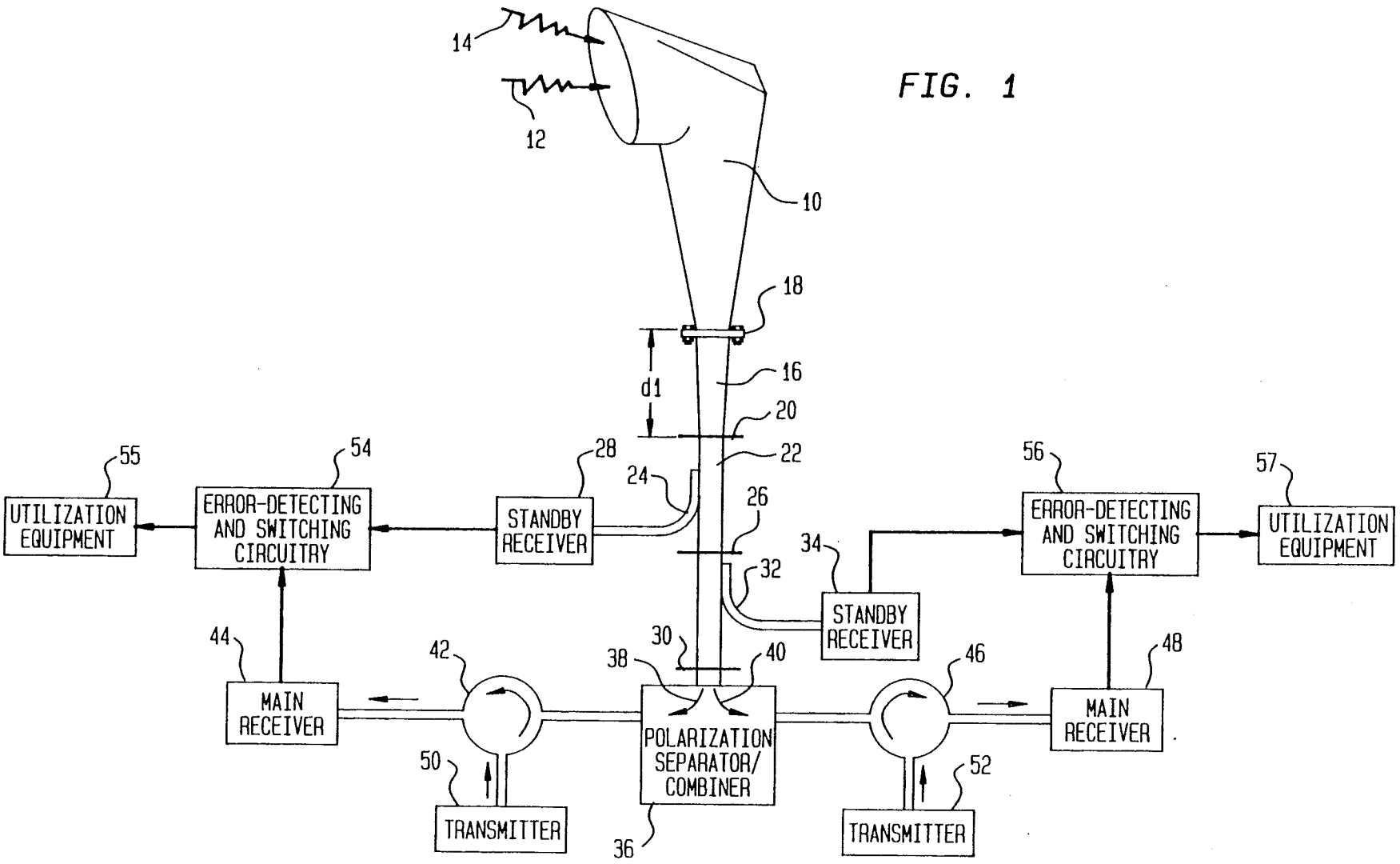
FIG. 1 shows a specific illustrative broadband radio receiving system made in accordance with the principles of the present invention.

Due to frequency-selective or dispersive fading arising from known multipath phenomena during propagation through the atmosphere, radio signals received by a conical horn reflector antenna 10 shown in FIG. 1 will arrive both perpendicular to the aperture of the antenna (so-called boresight arrival) and off-normal with respect to the antenna aperture (so-called off-axis arrival). The directions of these boresight and off axis-signals are represented in FIG. 1 by arrows 12 and 14, respectively.

Signals arriving along the paths 12 and 14 shown in FIG. 1 cause a variety of modes o be excited in the antenna 10. These consist of the horizontally polarized fundamental mode $HE_{11}$, the vertically polarized fundamental mode $HE_{11}$, the vertically polarized higher-order modes $TM_{01}$ and $HE_{21}$, and the horizontally polarized higher-order modes $TE_{01}$ and $HE_{21}$. Ordinarily, a waveguide connected to the antenna 10 would be dimensioned to propagate only the aforespecified fundamental modes. In priorly known systems, the higher-order modes excited int eh antenna 10 would be purposely suppressed and, thus, would not propagate in the waveguide and be delivered to an associated receiver.

In accordance with the principles of the present invention, a waveguide element 16 connected to the antenna 10 of FIG. 1 is configured to derive specified modes from those excited int eh antenna. These specified modes purposely include both fundamental and higher-order modes whose respective susceptibilities to errors due to dispersive fading are substantially uncorrelated.

Illustratively, the waveguide element 16 of FIG. 1 comprises a circular cross-section-to-square cross-section transition element connected to the antenna 10 by a standard feed flange 18. By way of example, the inside diameter of the circular cross-section of the element 16 at the flange 18 is 9.144 centimeters (cm), and the length of each side of the square cross-section of the element 16 at connecting flange 20 is b 1.212 cm. Illustratively, the length d1 of the waveguide element 16 is 14.00 cm.

The function of the waveguide element 16 of FIG. 1 is to permit four specified modes to propagate in a main square cross-section waveguide 22 directly downstream of the connecting flange 20. (The cross-section of the waveguide 22 and of the bottom end of he element 16 are identical). These modes, which are derived from those excited int eh antenna 10, consist of the vertically polarized fundamental mode $TE_{01}$, the vertically polarized higher-order modes $TE_{11}$ and $TM_{11}$, the horizontally polarized fundamental mode $TE_{10}$, and the horizontally polarized higher-order mode $TE_{20}$.

In accordance with the invention, at least one of the higher-order modes propagated int eh main waveguide 22 of FIG. 1 is abstracted therefrom and delivered to a standby receiver. The correspondingly polarized fundamental mode continues to propagate downstream in the main waveguide 22 and is delivered to a main receiver.

By way of a specific example, the particular illustrative system shown in FIG. 1 includes instrumentalities for independently abstracting both polarizations of the higher-order modes from the main waveguide 22. A waveguide element 24 coupled to the main waveguide 22 between the flange 20 and a downstream connecting flange 26 serves to couple the horizontally polarized higher-order mode form the waveguide 22 to the waveguide element 24. In the element 24, this higher-order mode propagates as the $TE_{10}$ mode. In turn, the horizontally polarized $TE_{10}$ mode is delivered by the waveguide element 24 to a standby receiver 28.

Thus, the portion of the main waveguide 22 between the connecting flanges 20 and 26 constitutes, in combination with the adjacent portion of the waveguide element 24, a coupler for abstracting the specified horizontally polarized higher-order mode from the main waveguide. Significantly, the horizontally polarized fundamental mode and the vertically polarized fundamental and higher-order modes launched into the main waveguide 22 are substantially unaffected by the action of the coupler and continue to propagate downstream in the main waveguide.

Another portion of the main waveguide 22 constitutes a part of a second coupler depicted in FIG. 1. This second coupler, which includes a waveguide element 32 coupled to the main waveguide 22 between the flange 26 and a downstream connecting flange 30, serves to couple the vertically polarized higher-order mode from the waveguide 22 to the waveguide element 32. In the element 32, this higher-order mode propagates as the $TE_{10}$ mode. In turn, the vertically polarized $TE_{10}$ mode propagates in the waveguide element 32 to a standby receiver 34. Significantly, the vertically and horizontally polarized fundamental modes are substantially unaffected by the action of this second-described coupler and continue to propagate downstream in the main waveguide.

As indicated in FIG. 1, the main waveguide 22 terminates in a unit 36 that comprises a conventional polarization separator/combiner. During reception of signals, the unit 36 functions as a separator which directs the horizontally polarized fundamental mode in one direction, say to the left, and directs the vertically polarized fundamental mode in the other direction, as indicated by arrows 38 and 40, respectively. In turn, each mode propagates via a standard circulator to a main receiver. Thus, the horizontally polarized fundamental mode propagates via the circulator 42 to a main or on-line receiver 44. Similarly, the vertically polarized fundamental mode propagates via the circulator 46 to a main or on-line receiver 48.

Emphasis above has been directed to the receiving function performed by the antenna 10 and the afore-specified associated equipment. But such a system is of course ordinarily designed to serve also as a radio transmitter. To illustrate this capability of the depicted system, transmitters 50 and 52 are shown in FIG. 1 connected to the circulators 42 and 46, respectively.

Horizontally polarized fundamental-mode signals provided by the transmitter 50 of FIG. 1 are applied to the unit 36 via the circulator 42, and vertically polarized fundamental-mode signals provided by the transmitter 52 are applied to the unit 36 via the circulator 46. In turn, the unit 36 combines these fundamental modes and applies them to the main waveguide 22 for propagation to the antenna 10. In turn, these modes are then transmitted via the atmosphere to one or more distance antennas (not shown).

The particular illustrative system shown in FIG. 1 is capable of simultaneously receiving separate and distinct vertically polarized and horizontally polarized radio channels each carrying independent digital information. The horizontally polarized channel involves the main receiver 44 and the associated standby receiver 28, whereas the vertically polarized channel involves the main receiver 48 and the associated standby receiver 34. In each case, the identical information received by the associated pair of receivers is substantially uncorrelated insofar as susceptibility to dispersive-fading errors goes. Thus, a high likelihood exists that if an error occurs in the information delivered to the main receiver, the corresponding information delivered to he associated standby receiver will be error-free.

By conventional error control techniques, it is a straightforward matter to detect the occurrence of errors on a bit-by-bit basis in the digital signal train received by the FIG. 1 system. Thus, for example, conventional error-detecting and switching circuitry 54 determined whether the output of the main receiver 44 or that of the standby receiver 28 is to be applied to utilization equipment 55. Whenever an error is detected to occur in a bit received by the main receiver 44, the circuitry 54 blocks that bit from being applied to the equipment 55 and instead applies thereto the corresponding bit form the standby receiver 28. In a similar fashion, error-detecting and switching circuitry 56 determines on a bit-by-bit basis whether the output of the main receiver 48 or that of the standby receiver 34 is to be applied to utilization equipment 57.

It is known that multi-apertured directional couplers are effective to transfer energy from one waveguide into another. In particular, such a device can be utilized to transfer higher-order-mode energy from a main antenna feed waveguide into a separate waveguide coupled thereto. A specific illustrative coupling structure designed to abstract the horizontally polarized higher-order mode from the main waveguide 22 of FIG. 1 at a frequency of 31 GHz is shown in FIG. 2.

Figure 2:
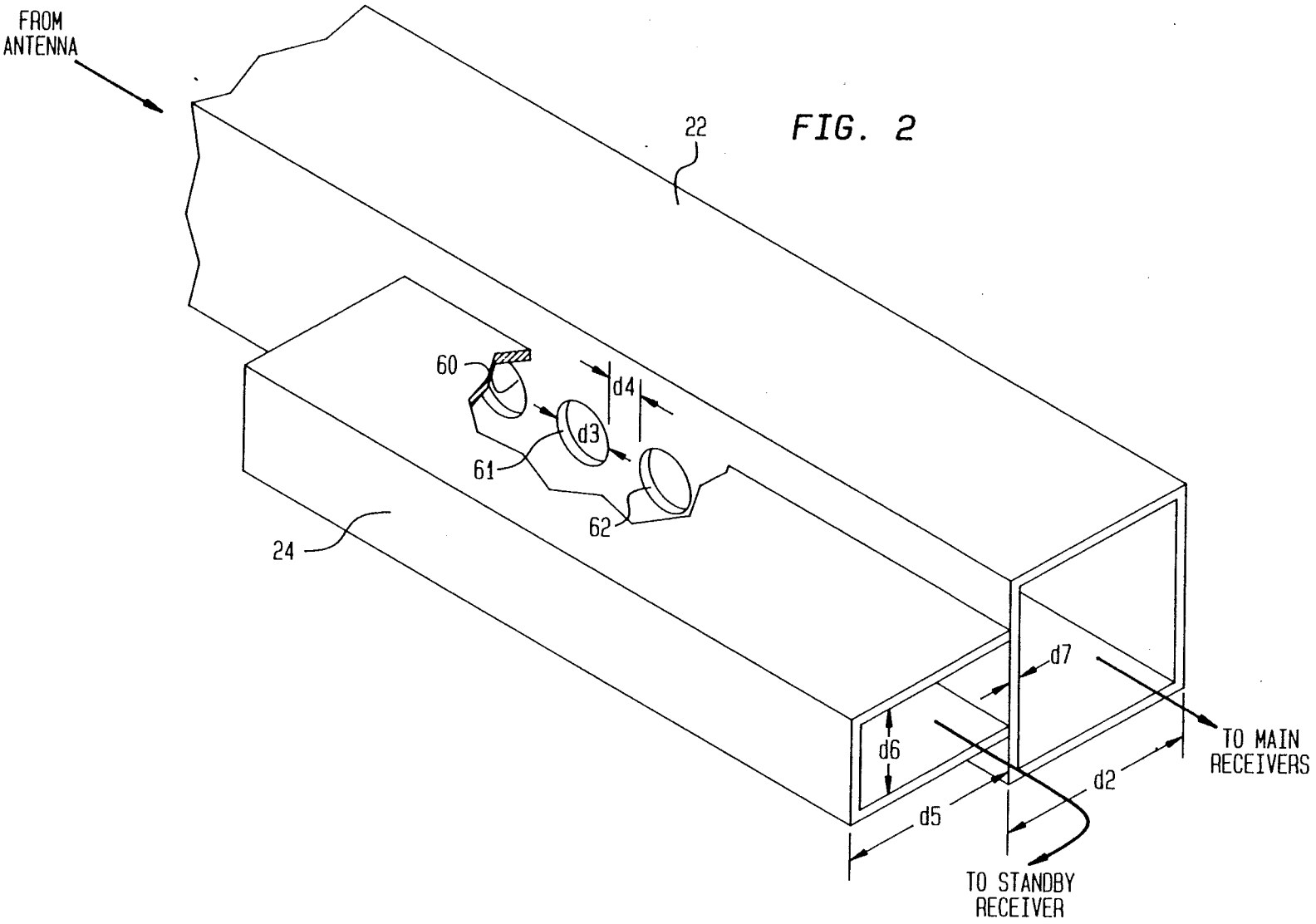
FIG. 2 depicts a portion of a particular coupler utilized to abstract higher-order mode signals from a main waveguide of the FIG. 1 system.

As indicated in FIG. 2, the main square waveguide 22 includes circular apertures in one sidewall thereof. In one particular illustrative embodiment, each side of the waveguide 22 has a dimension d2 of 1.212 cm. Twenty-six apertures 60, 61, 62 . . . each having a diameter d3 of 0.254 cm, and evenly spaced apart from each other by a distance d4 of 0.020 cm, are formed in the indicated sidewall of the waveguide 22.

The waveguide element 24 of FIG. 2 includes an open-sided portion whose edges are in contact with the apertured sidewall of he main waveguide 22. This contacting open-sided portion of the element 24 encompasses the 26 apertures 60, 61, 62 . . . and has, for example, a coupling length of about 7.124 cm. Illustratively, the width d5 and the height d6 of the element 24 are 05791 cm and 0.356 cm, respectively The thickness d7 of the wall separating the main waveguide 22 and the waveguide element 24 is 0.020 cm.

In practice, the coupling structure shown in FIG. 2 is effective to transfer horizontally polarized higher-order-mode energy propagating in the square main waveguide 22 into the rectangular waveguide element 24 with high efficiency. In turn, the energy so transferred is delivered to the standby receiver 28 shown in FIG. 1.

As described earlier above, the higher-order-mode energy propagates in the square waveguide 22 as the $TE_{20}$ mode and in the rectangular element 24 as the $TE_{10}$ mode. Moreover, as also noted earlier above the aforespecified coupling structure is substantially transparent to both polarizations of the fundamental mode and to the vertically polarized higher-order mode. Accordingly, these polarizations propagate substantially intact toward the main receiver(s) of the system.

If two main receivers are included in the system for receiving separate and distinct information channel comprising the horizontally and vertically polarized fundamental modes, respectively, then an additional coupling structure such as the one schematically depicted in FIG. 1 is positioned downstream of the FIG. 2 structure to abstract from the main waveguide 22 the vertically polarized higher-order mode. This downstream coupling structure includes a multi-apertured wall portion of the main waveguide 22 in contact with an open-sided portion of the waveguide element 32 (FIG. 1). In particular, the dimensions of the two waveguides and the size and spacing of the apertures in the waveguide 22 are selected in accordance with known design criteria to provide an additional coupling structure that is adapted to transfer vertically polarized higher-order-mode energy propagating in the main waveguide 22 as the $TE_{11}$ and $TM_{11}$ modes into the waveguide element 32 wherein the vertically polarized higher-order-mode energy propagates as the $TE_{10}$ mode.

A system made in accordance with the principles of the present invention may include two in-line couplers of the type specified above and indicated in FIG. 1. Such a system comprises two main receives and two respectively associated standby receivers for providing pattern-diversity reception for each of two separate and distinct information channels. Alternatively, only one of the couplers shown in FIG. 1 may be included in a system made in accordance with the invention. In such an alternate system, only the horizontally polarized higher-order-mode energy or the vertically polarized higher-order-mode energy, but not both forms, would be abstracted form the main waveguide 22 and delivered to a standby receiver. In that case, only a single main receiver is provided to receive the correspondingly polarized fundamental mode and thereby provide pattern-diversity reception for a single channel.

In practice, the couplers described herein can usually be relatively easily and inexpensively retrofitted to existing horn antenna installations to provide a high degree of protection against dispersive fading. Moreover, this improvement is typically achieved without degrading sidelobe performance.

Finally, it is to be understood that the above-described arrangements are only illustrative of the principles of the present invention. In accordance with these principles, numerous modifications and alternatives may be deviced by those skilled in the art without departing from the spirit and scope of the invention.

What is claimed is:

1. A terrestrial digital microwave system comprising antenna means responsive to the arrival of boresight and off-axis microwave signals for exciting therein fundamental and higher-order modes, a main waveguide, means interposed between said antenna means and said main waveguide for applying to said main waveguide specified horizontally polarized and vertically polarized fundamental and higher-order modes derived from the modes excited in said antenna means, a standby receiver for receiving only higher-order modes, means for abstracting one polarization of said higher-order modes directly from said main waveguide and delivering said abstracted mode via another waveguide to said standby receiver while allowing the polarizations of said fundamental mode and the other polarization of said higher-order modes to propagate substantially intact in said main waveguide, and a main receiver coupled to said main waveguide for receiving therefrom the polarization of said fundamental mode that corresponds to the higher-order mode delivered to said standby receiver, said main receiver receiving only fundamental modes.

2. A terrestrial digital microwave system comprising antenna means responsive to the arrival of boresight and off-axis microwave signals for exciting therein fundamental and higher-order modes, a main waveguide, means interposed between said antenna means and said waveguide for applying to said main waveguide specified horizontally polarized and vertically polarized fundamental and higher-order modes derived from the modes excited in said antenna means, a standby receiver, means for abstracting one polarization of said higher-order modes from said main waveguide and delivering said abstracted mode via another waveguide to said standby receiver while allowing the polarizations of said fundamental mode and the other polarization of said higher-order modes to propagate substantially intact in said main waveguide, a main receiver coupled to said main waveguide for receiving therefrom the polarization of said fundamental mode that corresponds to the higher-order mode delivered to said standby receiver, utilization equipment for receiving signals from either said main receiver or said standby receiver, and means connecting said main receiver to said utilization equipment for detecting on a bit-by-bit basis the occurrence of an error in the bits delivered to said main receiver and for temporarily connecting said standby receiver rather than said main receiver to said utilization equipment.

3. A system as in claim 2 wherein the fundamental and higher-order modes excited in said antenna means comprise the horizontally polarized fundamental mode $He_{11}$, the vertically polarized fundamental mode $HE_{11}$, the vertically polarized higher-order modes $TM_{01}$ and $HE_{21}$, and the horizontally polarized higher-order modes $TE_{01}$ and $HE_{21}$.

4. A system as in claim 3 wherein the specified horizontally and vertically polarized fundamental and higher-order modes derived from the modes excited in said antenna means comprise the horizontally polarized fundamental mode $TE_{10}$, the vertically polarized fundamental mode $TE_{01}$, the vertically polarized higher-order modes $TE_{11}$ and $TM_{11}$, and the horizontally polarized higher-order mode $TE_{20}$.

5. A system as in claim 4 wherein said means interposed between antenna means and said main waveguide comprises a circular cross-section-to-square cross-section transition waveguide element.

6. A system as in claim 5 wherein said main waveguide has a square cross-section identical to the square cross-section of said transition element.

7. A system as in claim 6 wherein said other waveguide comprises a rectangular waveguide element coupled to a multi-apertured wall of said square cross-section main waveguide.

8. A system as in claim 7 wherein the mode extracted form the said main waveguide comprises the horizontally polarized higher-order $TE_{20}$ mode, the mode extracted from said main waveguide that is then propagated in said rectangular waveguide to said standby receiver comprises the horizontally polarized higher-order $TE_{10}$ mode, and the mode delivered to said main receiver comprises the horizontally polarized fundamental $TE_{10}$ mode.

9. A system as in claim 7 wherein the mode extracted from the said main waveguide comprises the vertically polarized higher-order $TE_{11}$ and $TM_{11}$ modes, the mode extracted form said main waveguide that is then propagated in said rectangular waveguide to said standby receiver comprises the vertically polarized higher-order $TE_{10}$ mode, and the mode delivered to said main receiver comprises the vertically polarized fundamental $TE_{01}$ mode.

10. A system as in claim 7 further including an additional standby receiver and an additional main receiver, and wherein an additional means for abstracting is coupled to said main waveguide downstream of said first-mentioned means for abstracting, said additional means for abstracting being to abstract the other polarization of said higher-order modes from said main waveguide and to deliver said abstracted mode to said additional standby receiver while allowing the polarizations of said fundamental mode to propagate substantially intact in said main waveguide to said main and additional main receivers, respectively.

11. A system as in claim 10 further including additional utilization equipment for receiving signals from either said additional main receiver or said additional standby receiver, and means connected said additional main receiver to said additional utilization equipment for detecting on a bit-by-bit basis the occurrence of an error in the bits delivered to said additional main receiver and for temporarily connecting said additional standby receiver rather than said additional main receiver to said additional utilization equipment.

12. A system as in claim 11 wherein said antenna means comprises a conical born reflector antenna.

13. A terrestrial microwave system comprising antenna means responsive to the arrival of boresight and off-axis microwave signals for exciting therein fundamental and higher-order modes, a main receiver, a standby receiver, means responsive to the modes excited in said antenna means for applying a specific fundamental mode to said main receiver, means responsive to the modes excited in said antenna means for applying a specific higher-order mode to said standby receiver, utilization means, and means responsive to error comparisons between the respective outputs of said standby and main receivers to select a specific one of said receivers for connection to said utilization means.

14. A terrestrial digital microwave system comprising antenna means responsive to the arrival of boresight and off-axis microwave signals for exciting therein fundamental and higher-order modes, a main waveguide, means interposed between said antenna means and said main waveguide for applying to said main waveguide specified horizontally polarized and vertically polarized fundamental and higher-order modes derived from the modes excited in said antenna means, a first standby receiver for receiving only a first polarization of higher-order modes, a second standby receiver for receiving only a second polarization of higher-order modes, means for abstracting said first polarization of higher-order modes directly from said main waveguide and delivering the abstracted first polarization of higher-order modes via another waveguide to said first standby receiver while allowing the polarizations of said fundamental modes and the other polarizations of higher-order modes to propagate substantially intact in said main waveguide, means for abstracting said second polarization of higher-order modes directly form said main waveguide and delivering the abstracted second polarization of higher-order modes via a further waveguide to said second standby receiver while allowing the polarizations of said fundamental modes to propagate substantially intact in said main waveguide, a first main receiver coupled to said main waveguide for receiving therefrom said first polarization of fundamental modes that corresponds to the higher-order mode delivered to said first standby receiver, and a second main receiver coupled to said main waveguide for receiving therefrom said second polarization of fundamental modes that corresponds to the higher-order mode delivered to said second standby receiver, said first and second main receivers receiving only fundamental modes.

* * * * *

UNITED STATES PATENT AND TRADEMARK OFFICE

CERTIFICATE OF CORRECTION

PATENT NO. : 4,994,819

DATED : February 19, 1991

INVENTOR(S) : Anthony R. Noerpel

It is certified that error appears in the above-identified patent and that said Letters Patent is hereby corrected as shown below:

Column 2, line 57, "modes o" should read --modes to--;
line 66, "int eh" should read --in the--.
Column 3, line 4, "int eh" should read --in the--;
line 16, delete "b";
line 22, "he element" should read --the element--;
line 24, "int he" should read --in the--;
line 30, "int he" should read --in the--.
Column 4, line 49, "he" should read --the--;
line 62, "form" should read --from--.
Column 5, line 18, "he" should read --the--.
Column 6, line 21, "deviced" should read --devised--.
Column 7, line 29, after "between" insert --said--;
line 39, "form" should read --from--;
line 61, after "being" insert --adapted--.
Column 8, line 12, "born" should read --horn--;
line 51, "form" should read --from--.

Signed and Sealed this

Twelfth Day of July, 1994

Bruce Lehman

*Attest:*

BRUCE LEHMAN

*Attesting Officer*

*Commissioner of Patents and Trademarks*